United States Patent [19]

Martinez

[11] 4,065,067

[45] Dec. 27, 1977

[54] SYSTEM FOR AUTOMATIC COUPLING OR SPLICING OF BOBBINS, SUBMITTING A STRIP TO A CONTINUOUS FEED PROCESS FOR PAPER MANUFACTURING MACHINES

[76] Inventor: D. Manuel Torres Martinez, Sancho El Fuerte 21-8°C, Pamplona, Spain

[21] Appl. No.: 724,992

[22] Filed: Sept. 20, 1976

[30] Foreign Application Priority Data

Sept. 30, 1975 Spain ..... 441391

[51] Int. Cl.[2] ..... B65H 19/18

[52] U.S. Cl. ..... 242/58.1

[58] Field of Search ..... 242/58.1, 58.5, 75.43; 156/509

[56] References Cited

U.S. PATENT DOCUMENTS

| | | | |
|---|---|---|---|
| 3,836,089 | 9/1974 | Riemersma | 242/58.1 |
| 3,841,944 | 10/1974 | Horris | 242/58.1 |
| 3,891,158 | 6/1975 | Shearar | 242/58.1 |

*Primary Examiner*—Edward J. McCarthy

*Attorney, Agent, or Firm*—Eyre, Mann, Lucas & Just

[57] ABSTRACT

A continuous paper supply is provided from alternative supply rolls by momentarily stopping the paper being supplied and adhesively joining the leading edge of a new supply severing the old supply and accelerating the new supply. A loop of paper is paid out during the momentary stoppage of the acceleration of the new supply and is thereafter recovered in preparation for the next changeover. An idler roller senses tension in the paper and generates a signal to the supply. The idler roller is capable of skewing to equalize tension across the paper.

10 Claims, 4 Drawing Figures

FIG. 1

SYSTEM FOR AUTOMATIC COUPLING OR SPLICING OF BOBBINS, SUBMITTING A STRIP TO A CONTINUOUS FEED PROCESS FOR PAPER MANUFACTURING MACHINES

In paper dispensing machines, it commonly happens that the reels have to be changed, or rather that the tail end of the paper from the expended reel has to be joined to the beginning of the strip from the new one, this being a task which involves wasted time, or stopping the dispensing equipment whilst the change is being made, which in turns means a lack of continuity in the supply of paper.

With the improvements proposed under the present application, it becomes possible to achieve a continuous and uniform paper supply, where this is in no way affected by the operation of changing over from one reel to another, and where moreover the sequence of operations which the machine attendant is required to follow for this purpose is exceedingly quick and easy to accomplish.

To this end, the system is comprised of two sets of equipment, each one opposite to the other, and carrying a reel; such sets of equipment being made up from rollers, blades for shearing, and parts for gripping and joining the strips of paper. The equipment is arranged to guide the paper as it is drawn off the respective reel during the dispensing process, and at the time when the change over takes place, it automatically joins the tail end of the strip from the expended reel to the commencement of the strip from the new reel, and then goes on guiding it while it is being dispensed.

The system comprises also an arrangement for storing paper in order to ensure it is at all times dispensed in a continuous and uniform manner, even whilst the reels are being changed over; and such paper storing arrangement is made up from one or more forward rollers over which the strip is threaded and led rearwards again, together with a travelling rear roller, over whose surface the strip runs and thence goes forwards once more towards the machine where it is being consumed. The travelling rear roller is arranged so that it can travel forwards in the same direction as the strip being dispensed, and this it does whilst the reels are being changed over, so that it pays out some of the paper kept in store until the fresh reel has started to revolve at the required speed to keep pace with the rate of demand. For this purpose, the travelling roller in question is slung in a chain between two spindles, of which one is controlled by a non-reversing motor through a clutch, in such a way that the travelling roller is allowed to move forwards during the reel changing operation, whereafter it is drawn back again and held at its rearmost position; and where moreover the system is fitted with suitable arrangements to make the paper being dispensed be fed at a pre-set constant tension or pull, and avoiding any eventual variations in the tension or pull of the strip which may possibly tend to arise; while furthermore it governs continually the speed of each dispenser reel, so that the paper is at all times supplied at the right speed and at a suitable tension, but nevertheless with continuous compensation being applied to offset the effect of the continuous change in the diameter of the reel, which it will be appreciated decreases as the strip is drawn off it. For this purpose, the improvement covered by this invention consists in the roller at the forward end of the paper storing arrangement being mounted in a floating manner, and in constant balance between the pulling force resulting from the tension in the strip, and the thrust being applied by a number of adjustable compressed air operated cylinders. Hence the roller moves to and fro whenever the tension in the strip of paper alters, and at all times it does so in the direction required to restore the balance between these two forces. Moreover, there is a relationship between such to and fro motion of the roller, and the air brakes fitted on the reel supports, so that by means of this relationship and this to and fro motion, it is the actual variations in the tension of the strip which cause the brake on the reel to be applied as hard as required in each instance, so as to apply continual compensation and to ensure that the strip is dispensed at the preset constant tension, with any possible fluctuations being nullified.

The arrangement is therefore a highly advantageous one, inasmuch as the perfect balance between the two forces means that the tension of the paper is kept constant throughout the whole dispensing operation, regardless of the diameter of the reel; since the regulating factor is taken as the fluctuations in the tension of the strip, and there can therefore be no other effect which might interfere in the tensioning process, because such arrangement works on the basis of a double and interlinked operation, whereby on the one hand it avoids any eventual fluctuations in the tension of the strip by travel of the roller to pay out or take up the paper, while on the other it removes the causes tending to bring about such fluctuations by means of suitable adjustment of the braking force being applied to the reel. Hence the arrangement adopted possesses an increased degree of reliability and sensitiveness because of the actual principle upon which it operates, and moreover it is very much simpler and straightforward than other arrangements based upon less reliable operating principles; while it is furthermore to be noted that in addition, the floating roller avoids any possible differences in tension between the opposing edges of the strip, because whenever there is a greater or a lesser strain at either edge of the paper, the roller will swivel longitudinally so as to restore an even degree of tautness across the whole width of the strip, thus ensuring that it is dispensed properly, since any possible differences in the tension between one edge and the other are removed, such differences being very frequent and arising almost always as the result of uneveness in the paper wound on the reel being dispensed.

And the whole system described above is in addition designed so that in the course of the commencement of the paper being fed from each new reel, both these effects, which respectively are the motion of the floating roller, and the control and adjustment of the force being exerted by the brake on the reel, are made to take place in conjunction with a third one to produce the required acceleration of the reel without the need of any other means therefor, while in the meantime the strip of paper continues to dispensed due to forward motion of the travelling roller in the storage arrangement. To this end, the drive spindle controlling the rear travelling roller is arranged for its air operated clutch to be engaged, so that when the operation involving changing over the reel is carried out, then in the course of the foreward travel of this roller during the operation, a progressively increasing force is exerted upon the clutch, even though the return travel motion decreases progressively; and in this manner the paper is held by a force which increases progressively. This progressively increasing holding force being exerted upon the paper gives rise to a progressive travel motion of the floating roller, and this in turn causes there to be a progressive decrease in the force being applied by the brake on the reel, which becomes tantamount to a progressive acceleration of the reel, so that by the end of a very short period of time, the tangential speed of the reel is such as to be sufficient to allow it to dispense the paper satisfactorily by itself. In this way, the desired result is achieved, whereby by means of the three effects working in conjunction with one another, there is proper and suitable balance throughout the whole system during the commencement of the paper being dispensed from each fresh reel.

Figure 4:
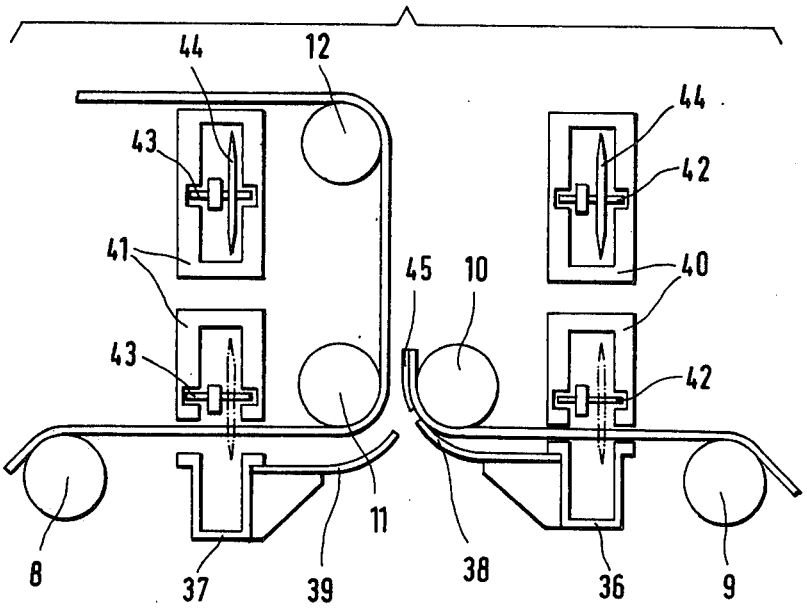
FIG. 4 shows schematic details of the means for making the joins between successive strips, these being enclosed within the dotted circle in FIG. 1.

Base plate 1 is fitted on each of its sides with a pair of arms 2, 6 carrying reels of paper 3,5, and for each one of these reels of paper, there is a paper strip joining mechanism (see FIG. 4), each having two guide rollers 8, 9 and two joining rollers 11,10 in conjunction with their respective steel sections 36,37 carrying steel strips 38,39, each of which has its respective guide 40,41 for supporting chains 42, 43, these being extended in either direction in the transverse plane, and at one end of one of the lengths of each chain, there is a shearing blade 44. All of the above equipment is arranged in two separate sets, these each being installed on its respective trolley 4, which by means of rack and pinion gears driven by suitable motors, can be made to travel from the central area to their outer limits, and this travel motion is applied to one or other trolley 4, as required to prepare new reel 3 before the other reel 5 is expended, in accordance with the following procedure:

PREPARING THE REEL

Figure 1:
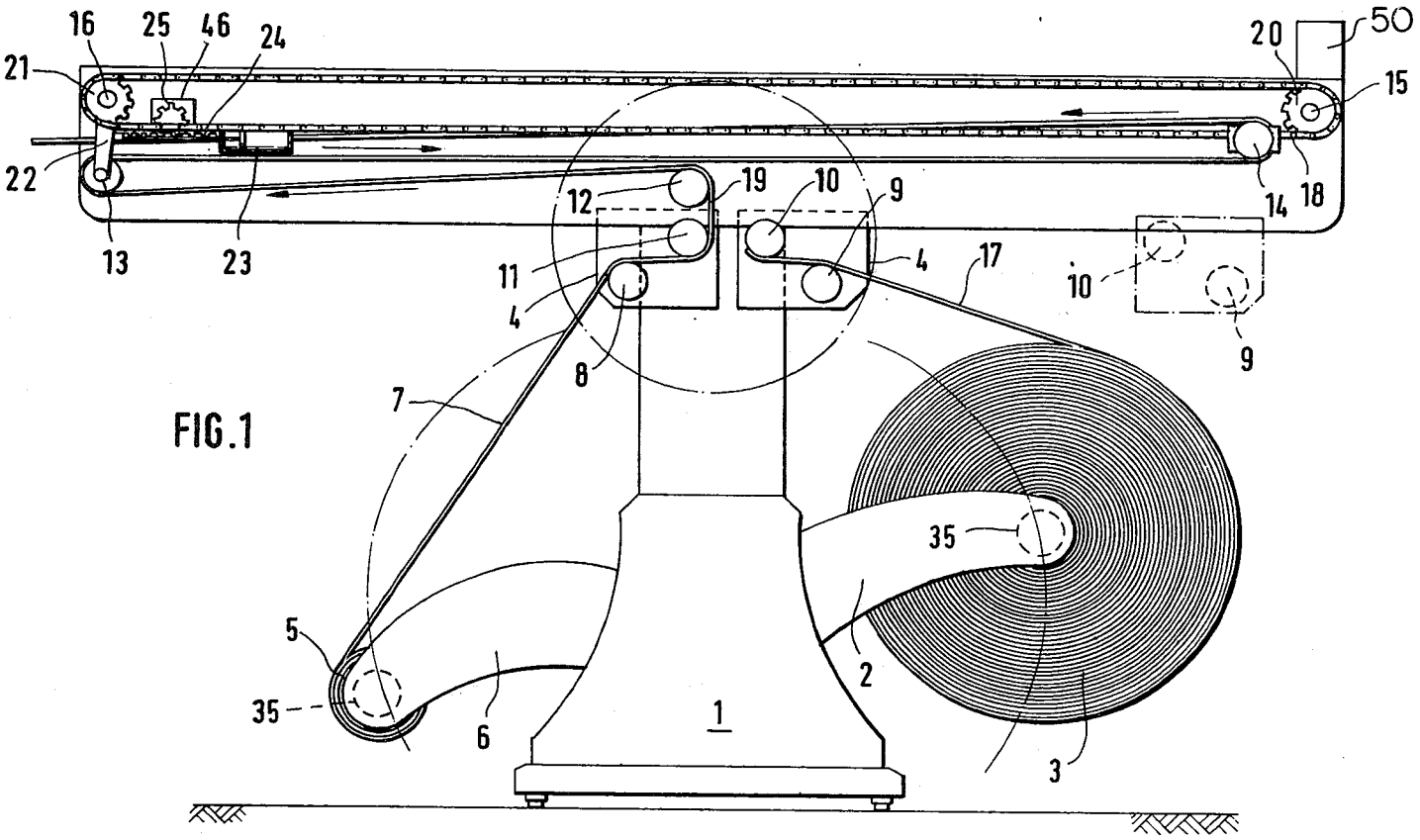
FIG. 1 shows schematic details of the automatic paper strip joining system, in accordance with the present invention.

In order to make the new reels ready, in this case reel 3, the appropriate trolley 4 is made to travel to the end of the machine, and in doing so it travels over reel 3, as shown by dotted sketch in FIG. 1. When trolley 4 is in this position, and hence accessible to the machine attendant, his task is to thread the commencement of the paper strip 17 over roller 9 and below roller 10, so as to be able to shear the end of strip 17 off square by means of the cutting equipment provided for this purpose between rollers 9, 10. When shearing is completed, the machine attendant places a strip of adhesive paper 45 on the outer face of paper 17, which is to run right across its width.

The end of strip 17 from reel 3 is gripped against roller 10 by means of strips 38, and meanwhile paper strip 17 is held in this position by pressure from steel section 36 against guide 40, since these two steel sections 36, 37 carrying steel strips 38, 39 are arranged so that they can travel upwards and downwards and in conjunction with positioners whose operation is synchronized, and which act in the upwards direction in this particular case.

A further structure is provided above to carry the parts comprising the paper storage arrangement, these being a forward roller 13, over which paper strip 19, runs and returns rearwards towards the travelling rear roller 14, and over which it then runs and returns forwards again and is then dispensed. Travelling rear roller 14 is mounted on a set of longitudinal rails, so as to enable it to travel forwards during the operation of changing reels, and it is attached to a chain 18 which is slung between spindles 15 and 16, these being provided with pinions 20 and 21, while spindle 15 carries an air operated clutch, through which it is connected to a non-reversing motor reducer gear unit, whose purpose it is to make roller 14 travel forwards and rearwards while reels are being changed, and to hold it stationary while the paper is being ordinarily dispensed.

Figure 2:
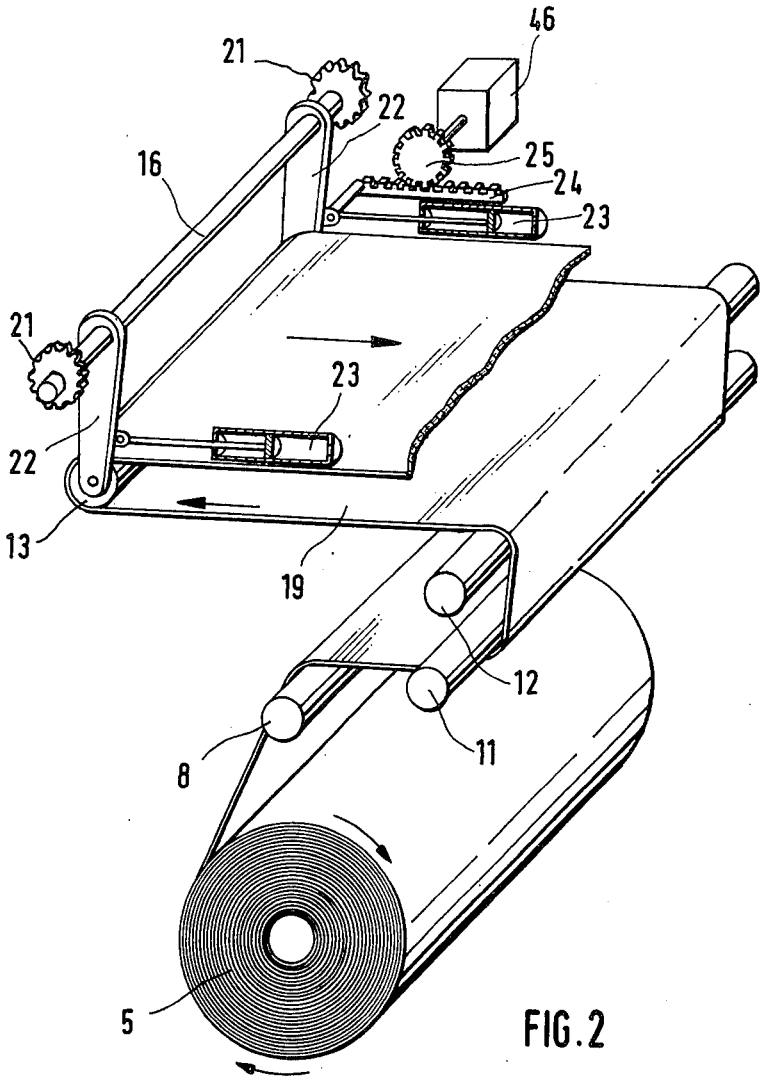
FIG. 2 is a schematic perspective view of the arrangement of the floating roller.

Moreover, forward roller 13 is now mounted in a floating fashion, with its end being ball and socket mounted onto two independent rods 22, where there is a compressed air cylinder 23 acting against each end of the roller, these being connected to a common air supply in accordance with FIG. 2, all in such a way that the roller 13 is in constant balance between the pulling forces arising from the tension in the paper strip 19, and the thrust exerted by the compressed air cylinders 23, so that it detects any possible differences in tautness between one edge of the strip and the other 19, since each end of the roller is fitted with an independent air cylinder 23 acting against the direction of pull from each edge. Hence, whenever there are differences in the degree of pull being exerted between one edge and the other, they are automatically removed due to the fact that roller 13 will swivel in the longitudinal plane through its being suspended from rods 22 through ball and socket joints, and so restore the balance in relation to compressed air cylinders 23. The swivelling motion of the roller thus has the effect of evening out the degree of tautness throughout the whole width of the strip of paper, and this is a feature which enables numerous difficulties to be overcome, particulary breakage of the strip of paper when there are tears along one of its edges.

In addition to this, the arrangement is capable of keeping the tension in the strip constant at pre-set values, due to the fact that roller 13 will move to and fro whenever there are fluctuations in the tension of paper strip 19, since at all times it tends to restore the balance between the total force being exerted by the compressed air cylinders 23, and the tension in the paper strip 19, while furthermore one of the plungers in compressed air cylinders 23 is connected to toothed rack 24, which engages directly or indirectly with a pinion attached to spindle 25 from a pressure regulator 46, this being connected to the air operated brakes 35 on the supports holding the reels, so as to adjust the degree to which such brakes are applied. The pressure regulator may be replaced by some other kind of electric or hydraulic device instead, and in accordance with whatever kind of brake is used on the rotating spindles which carry the reels of paper 3,5. The whole arrangement is designed in such a way that there is constant tension in paper strip 19 throughout the whole dispensing process, regardless of the diameter of the reel or of any other factor; because whenever there is any tendency towards an alteration in the degree of tension, roller 13 will travel in whichever direction is appropriate to offset such tension, this being achieved by taking up or paying out paper according to which way it travels; while at the same time, and as the result of this travel motion of roller 13, the plunger in the appropriate compressed air cylinder 23 will, by means of its toothed rack 24, act upon spindle 25 belonging to pressure regulator 46, thus causing it to move and make pressure regulator 46 act in such a manner as to modify the force being applied by the air brakes 35, so as to allow the reel to revolve at such a rate as the tangential speed is now the right one for the strip to be dispensed in such a manner as to remove the cause which may have brought about the alteration in the degree of tension in the strip. In point of fact, and for the sake of providing an alternative explanation of the operation of the system, the adjusting device or compressed air operated regulator 46 is arranged in such a way that when plunger in cylinder 23 is at rest in the middle of its stroke, the output signal from the regulator has a minimum value, whilst travel by the plunger to the extreme end of its stroke will cause the regulating device 46 to transmit its signal at maximum value. Hence, as the diameter of the reel 3 becomes smaller, there is a tendency for the tension in the strip to increase, because the force applied by brakes 35 is constant; and with the decrease in the radius of the reel 3, the tension torque will increase. However, as the thrust exerted by cylinders 23 is constant, roller 13 will become displaced in order to restore the balance, and upon doing so it will make plungers retract into cylinders 23, so that toothed rack 24 will travel rearwards, with the result that there is a decrease in the output signal from regulator 46, which causes the brakes 35 on the reels to be released by a certain amount, and so restore the tension in the strip to the value as preset, for the tautness required. All alterations in the tension of the strip which may be brought about by other causes, are similarly corrected in accordance with the sequence which has just been described.

It will be appreciated that the force exerted by compressed air cylinders 23 may be adjusted in accordance with the requirements of the quality of the paper being handled, by varying the air supply, and hence the tension at which the paper strip is to be dispensed is preset, whereafter this tension is maintained in the paper at all times by virtue of the system herein described.

By these means, the effects working together in the system operate are shown hereunder during the process of commencing the feed from each new reel of paper when placed in position for dispensing:

PAPER STRIP JOINING PROCESS

The process is begun either manually or automatically, in which latter case there is a leaking air receiver, a photo-electric cell, or other similar equipment arranged to detect the fact that the tail end of the paper strip is leaving the reel, and to show that it is expended, whereupon:

Steel section 37 comes into action to restrain the paper 7 from reel 5 against guide 41, and afterwards trolley 4 placed on the opposing reel 3, is automatically made to travel up against the other trolley 4, to the extent that rollers 10, 11 come into contact with each other, and between them they grip paper strips 7, 17 coming from reels 3,5, these being the tail end from reel 3 and the commencement from reel 5. Such tail end commencement are joined together with adhesive tape 45, whereupon shearing blade 44 belonging to the set of equipment for handling reel 5, begins its travel stroke due to the motion of its supporting chain 42, so as to trim off the unwanted paper 7, and afterwards steel sections 36,37 descend as soon as the end of strip 17 from the new reel 5 is joined onto the tail end of the strip from the expended reel 7,19, whereupon the new reel 5 begins to accelerate until its tangential speed of rotation reaches the required rate for normal dispensing.

Throughout the whole of this process, and until such time as the new reel 5 has reached its proper speed of rotation, paper is dispensed from the storage arrangement 19 due to the fact that roller 14 is in its forward position; it being of very special importance to note that for accelerating each new reel 3,5 as it is about to begin to be dispensed, no kind of accelerating rollers whatever are required, and instead the system is made up from a set of effects working in conjunction with one another, these effects being comprised of those which detect and remove any fluctuations in tension at roller 13, and of those resulting from the application or release of the air operated brakes 35, together with a special arrangement in the clutch on spindle 15 belonging to chain 18.

To this end, the air operated clutch on spindle 15 is connected to a selector control 26, and this in turn is joined on the one hand to a high pressure solenoide valve 27, and on the other to a pressure regulator 28, whose spindle 29 engages directly or indirectly with a spur wheel 52 on spindle 15 itself, so that when dispensing is ordinarily taking place, it is solenoide valve 27 which applies high pressure to the air operated clutch so as to keep spindle 15 connected to the motor brake, while the pressure regulator 28 is in this position at low pressure, but it is prevented from operating because selector 26 channels the pressure to solenoide valve 27, all in such a way that when spindle 15 rotates, the pressure regulator spindle 28 will turn upon being driven through linkage 30, 29, and there will therefore be a variation in the value of the signal from regulator 28 in accordance with rotation of spindle 15.

The actual operation of joining the ends of the strips of paper together is accomplished by solenoide valve 27 being blocked, and the clutch being connected to pressure regulator 28, due to which this clutch is kept at low pressure, thus releasing spindle 15, whereupon due to the pulling effect from the strip of paper 19, roller 14 begins to travel forwards with chain 18, causing spindle 15 to rotate; but while this rotation is taking place, with the resulting forward travel motion of roller 14, this affects spur wheel 29,52, which makes the regulator spindle 28 revolve, so that its pressure is progressively increased, with the accompanying proportionate increase in the force making the clutch engage, that is the force transmitted from the motor reducer unit 50 to the spindle 15; and meanwhile, when roller 14 returns, spindle 15 rotates in the opposite direction, whereupon the motor brake restrains spindle 15, since it is connected to it through the clutch. However, at this stage the engagement of the clutch decreases progressively until it is eventually substituted by the pressure coming from the solenoide valve 27. In this manner, the progressive increase in the restraint on roller 14 against the pull exerted by the paper strip while the roller is travelling forwards, causes floating roller 13 to be displaced, and in doing so it overcomes the force being exerted by the compressed air cylinders 23, so that there is a resulting action applied to the regulator 46, causing there to be a progressive decrease in the degree to which air operated brakes 35 are applied, with the result that the respective reel is subjected to constant acceleration while rotating, this all taking place in a progressive and balanced manner, so that paper strip is dispensed with no interruption during this period while the new reel is being commenced in each case, and dispensing takes place with the strip at a constant pre-set tension, while acceleration in the speed of rotation of the new reel is accomplished up to the rate required with the minimum amount of delay, as has been shown in the preceding descriptions.

Figure 3:
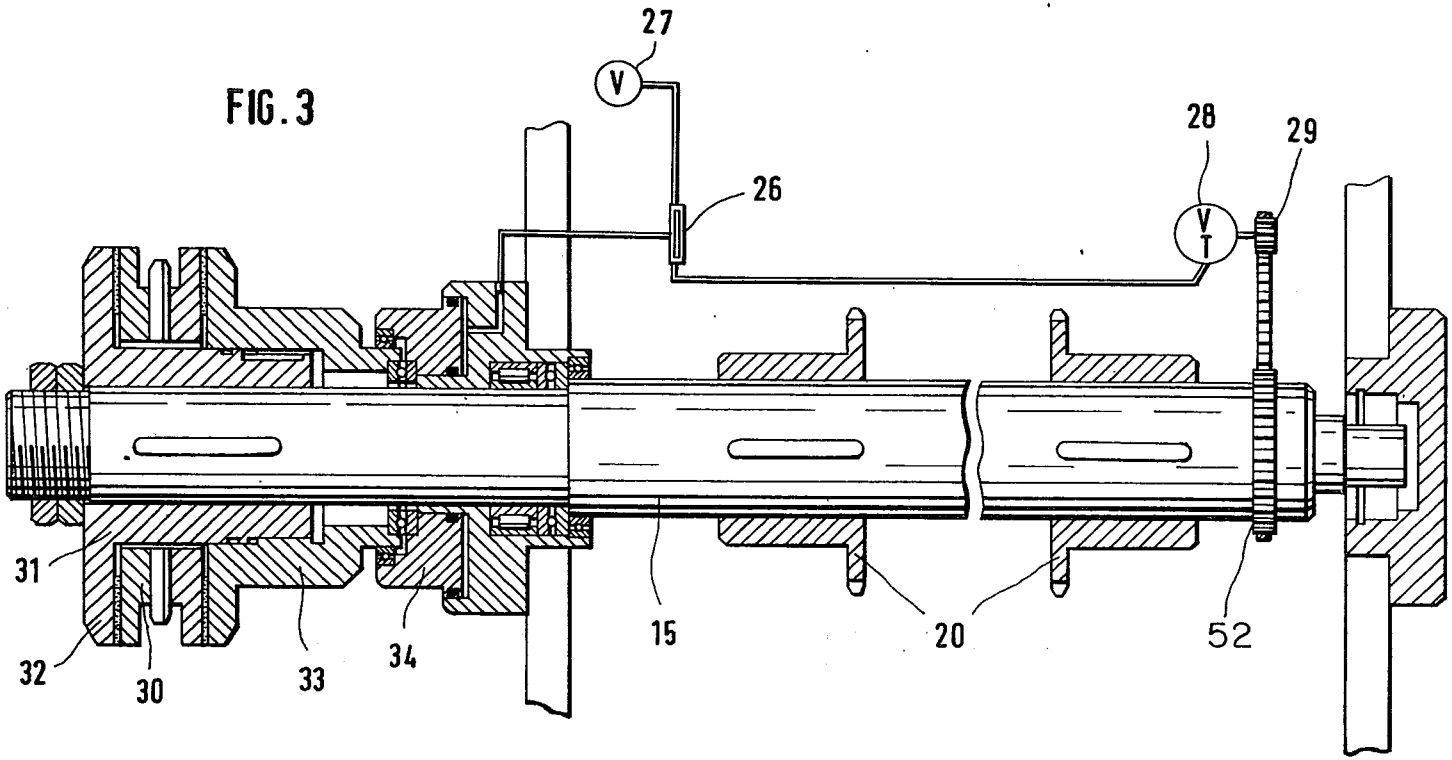
FIG. 3 depicts the control spindle for the chain in which the travelling roller is slung, and it shows schematically the parts for controlling the clutch which is installed on this spindle.

It only need be added that the air operated clutch on spindle 15 is comprised of a disc 30, with a wheel by means of which it is connected to the motor reducer gear unit; while disc 30 is coupled to a sleeve 31 on spindle 15, this being gripped between a fixed jaw 32 and a moving one 33, this latter being keyed to sleeve 31 and allowed to slide along it; and this moving jaw is acted upon by a further disc 34 which is subjected to air pressure as shown in FIG. 3, so that according to the amount of pressure which disc 34 exerts on moving jaw 33, the force which couples disc 30 to spindle 15 is made greater or lesser, and hence there is adjustment in the force transmitted from the motor brake to said spindle 15.

I claim:

1. Apparatus for continuously supplying paper in sequence without interruption from a plurality of supply rolls comprising:

a. a support frame;
b. said support frame having first and second support means for supporting first and second supply rolls of paper;
c. first and second means for retarding the rotation of said first and second supply rolls of paper respectively;
d. one of said supply rolls supplying paper, the other supply roll being available to begin supplying paper upon the at least partial exhaustion of the paper on said one supply roll;
e. first means for holding the leading edge of paper from said other supply roll adjacent to paper being supplied from said one supply roll;
f. a first roller;
g. said paper being supplied passing over said first roller;
h. said first roller being supported at its first and second ends by first and second arms;
i. said first and second arms being independently pivoted whereby said first roller is free to move in rotation about a common axis and to skew;
j. first and second pressure cylinders having plungers therein connected respectively to said first and second arms;
k. said first and second pressure cylinders being connected to a common source of pressure;
l. at least a second roller;
m. said paper being supplied passing over said second roller;
n. means for controlling translation of said second roller toward said first roller;
o. second means for holding the paper being supplied;
p. means for pressing the leading edge of the paper from said other supply roll against said paper being supplied;
q. means for severing the paper being supplied while it is being held by said second means for holding whereby the supplying of paper is transferred to said other supply roll; and
r. means for returning said second roller to its initial spaced position from said first roller.

2. Apparatus recited in claim 1 wherein said first means for holding comprises:

a. first trolley means operative to move toward and away from said paper being supplied;
b. at least one idler roller in said first trolley means;
c. a clamp in said first trolley means; and
d. said clamp in said first trolley means being operative to clamp the leading edge of paper from said other supply roll to said idler roller with the extreme end strip of said leading edge protruding therefrom.

3. Apparatus recited in claim 2 further comprising:

a. second trolley means having at least a second idler roller therein;
b. said paper being supplied passing over said second idler roller;
c. a second clamp in said second trolley means operative upon actuation to clamp the paper being supplied to said second idler roller; and
d. said one idler roller being abutable to said second idler roller.

4. Apparatus recited in claim 1 wherein said means for severing comprises:

a. at least one knife means; and
b. means for translating said at least one knife means transversely across said paper being supplied.

5. Apparatus recited in claim 1 wherein said means for controlling translation comprises:

a. first and second flexible energy transmitting means connected to first and second ends respectively of said second roller;
b. said first and second flexible energy transmitting means having means for maintaining synchronization therebetween;
c. means for holding said second roller in a first operative position spaced from said first roller during dispensing of paper;
d. means for at least partially releasing said first and second flexible energy transmitting means upon transferring the supplying of paper from said one to said other supply roll, whereby said second roller is permitted to translate toward said first roller;
e. means for progressively applying greater force to said first and second energy transmitting means in relationship to displacement of said second roller from its first operative position; and
f. said means for progressively applying greater force being operative to stop the motion of said second roller toward said first roller and being further operative to return said second roller to its first operative position.

6. Apparatus recited in claim 5 further comprising:

a. first and second said flexible energy transmitting means being first and second chains; and
b. said means for maintaining synchronization being first and second spindles engaged respectively with said first and second chains, and a shaft connecting said first and second spindles non-rotatably relative to each other.

7. Apparatus recited in claim 6 further comprising:

a. said means for at least partially releasing being a solenoid valve, a selector control and a fluid pressure operated clutch;
b. said clutch being connected to said shaft; and c. said solenoid valve releasing fluid pressure through said selector control from said clutch upon said transferring, whereby said spindles are freed to rotate.

8. Apparatus recited in claim 7 wherein said means for progressively applying greater force comprises:

a. a pressure regulator having an input means actuated in proportion to the rotation of said shaft;

b. said pressure regulator being operative to supply fluid pressure to said fluid pressure operated clutch in relationship to the actuation of its input means; and c. motor means connectable through said fluid pressure operated clutch to said shaft.

9. Apparatus recited in claim 1 further comprising:

a. means for generating a signal varying in proportion to the motion of one of said first and second arms; and b. said first and second means for retarding being actuated in relationship to said signal.

10. Apparatus recited in claim 9 wherein said means for generating comprises:

a. a rack mechanically connected for motion with one of said first and second arms;

b. regulator signal generating means;

c. a pinion meshed with said rack;

d. the shaft of said pinion providing a mechanical input to said regulator signal generating means; and e. said regulator signal generating means being operative to generate said signal in relationship to said mechanical input.

* * * * *